United States Patent [19]

Chambers, Jr.

[11] 4,092,841

[45] June 6, 1978

[54] SHEET METAL BRAKE

[75] Inventor: Clarence G. Chambers, Jr., Birmingham, Mich.

[73] Assignee: Jayson Corporation, Detroit, Mich.

[21] Appl. No.: 752,153

[22] Filed: Dec. 20, 1976

[51] Int. Cl.[2] ..... B21D 11/20

[52] U.S. Cl. ..... 72/320

[58] Field of Search ..... 72/319, 320, 321, 322

[56] References Cited

U.S. PATENT DOCUMENTS

| | | | |
|---|---|---|---|
| 1,721,698 | 7/1929 | Krueger | 72/319 |
| 2,357,277 | 8/1944 | Weimont | 72/322 |
| 2,880,780 | 4/1959 | Mackey | 72/151 |
| 3,383,899 | 5/1968 | Ercoline et al. | 72/319 |
| 3,482,427 | 12/1969 | Barnack | 72/319 |
| 3,914,974 | 10/1975 | DeVore | 72/319 |

*Primary Examiner*—Michael J. Keenan

*Attorney, Agent, or Firm*—Krass & Young

[57] ABSTRACT

A bending brake for sheet metal employs a long, upwardly facing fixed clamping surface supported on a base, and a long bending arm hinged to one edge of the clamping surface. An upper clamping surface is supported for movement toward and away from the fixed clamping surface at the first ends of a number of arms which extend normally to the clamping surface and are pivotably supported near their opposite ends for rocking motion about the base. Actuating means taking the form of a cam mechanism or fluid cylinder acts between the far ends of the arms and the base to bring the movable clamping surface into and out of engagement with the fixed clamping surface.

6 Claims, 6 Drawing Figures

SHEET METAL BRAKE

BACKGROUND OF THE INVENTION

This invention relates to bending brakes for sheet metal of the type having cooperating fixed and movable jaw surfaces for the sheet and a hingedly supported bending arm which operates on the extending section of a sheet clamped by the jaws.

Prior Art

Large, stationary brakes for making angular bends in sections of sheet metal which employ a pair of jaws and a bending arm hinged to one of the jaws operative to engage the extending section of a sheet workpiece clamped between the jaws have long been used in shops for forming sheet metal duct work and the like. In recent years the increased use of aluminum as a siding or veneer material for buildings has given rise to the development of a class of portable, light-weight brakes that may be used in the field by workmen applying aluminum siding to a structure, to custom form sections required to conform to window and door openings and the like. These brakes have typically employed a number of, spaced C shaped frame members joined together by rails. A fixed work clamping surface extends along one end of each of the frames, and a movable work clamping surface is supported on the other edge of the frames and is movable toward and away from the fixed surface by some form of cam mechanism. U.S. Pat. Nos. 3,559,444 and 3,817,075 illustrate a popular form of these presses wherein the movable clamp is actuated by sliding wedges which move normally to the C members to force the movable clamp into engagement with the fixed clamp. U.S. Pat. Nos. 3,481,174 and 3,482,427 disclose a variation of this structure in which the movable clamp member is pivotably supported on the end of the C frame and is moved into clamping position by a manually energized linkage also supported on the free end of the frame.

These C frame structures all suffer from the disadvantage that in use the actuating mechanisms for the movable clamp tend to wear and loosen so that the clamp may be moved laterally. This results in misalignment between the acute angular bending edge of the movable clamp surface with respect to the bending arm. The C frame members themselves are also relatively heavy, expensive to form, and susceptible to breakage at their throats.

SUMMARY OF THE INVENTION

The present invention relates to a lightweight, low cost sheet metal bending brake which overcomes the disadvantages of these prior art devices. Rather than employing C frame members the brake of the present invention employs a series of base members, joined together by rails, which support the fixed clamping surface and the hinged bending arm, and an independent upper arm structure comprising a number of arms extending parallel to these base members and pivotably connected to the base members at points between the two ends of the arms. At one end these arms each connect to and support an elongated movable clamping member. The arms may be pivoted about the base members to move the clamping member into engagement with the fixed clamping surface by an actuator mechanism which operates between the base members and the ends of the arms on the opposite sides of the pivot points from the clamping surface. These actuators may take the form of cam mechanisms or fluid operated cylinders. When energized, they cause the movable clamping member to rock into engagement with the fixed clamping member. Preferably, the pivot points for the arms are substantially closer to the actuator than to the clamping member so a relatively short motion of the actuator member produces a relatively large motion of the clamping member. This lever advantage insures firm engagement of the clamping surfaces despite wear of the structure which may occur in use.

The elimination of the clamp actuating members supported on the free ends of the upper arms also opens the press to allow easy insertion and removal of workpieces from either end of the press.

The actuators associated with the upper arms may be energized simultaneously, or, in an alternative structure which will subsequently be described, one of the arms may first be clamped to pin a corner of a sheet workpiece between the clamps, allowing the balance of the sheet to be pivoted about that point to align the workpiece with respect to the press before the other clamps are closed.

Other objectives, advantages and applications of the present invention will be made apparent by the following detailed description of the preferred embodiments of the invention. The description makes reference to the accompanying drawings, in which.

Figure 1:
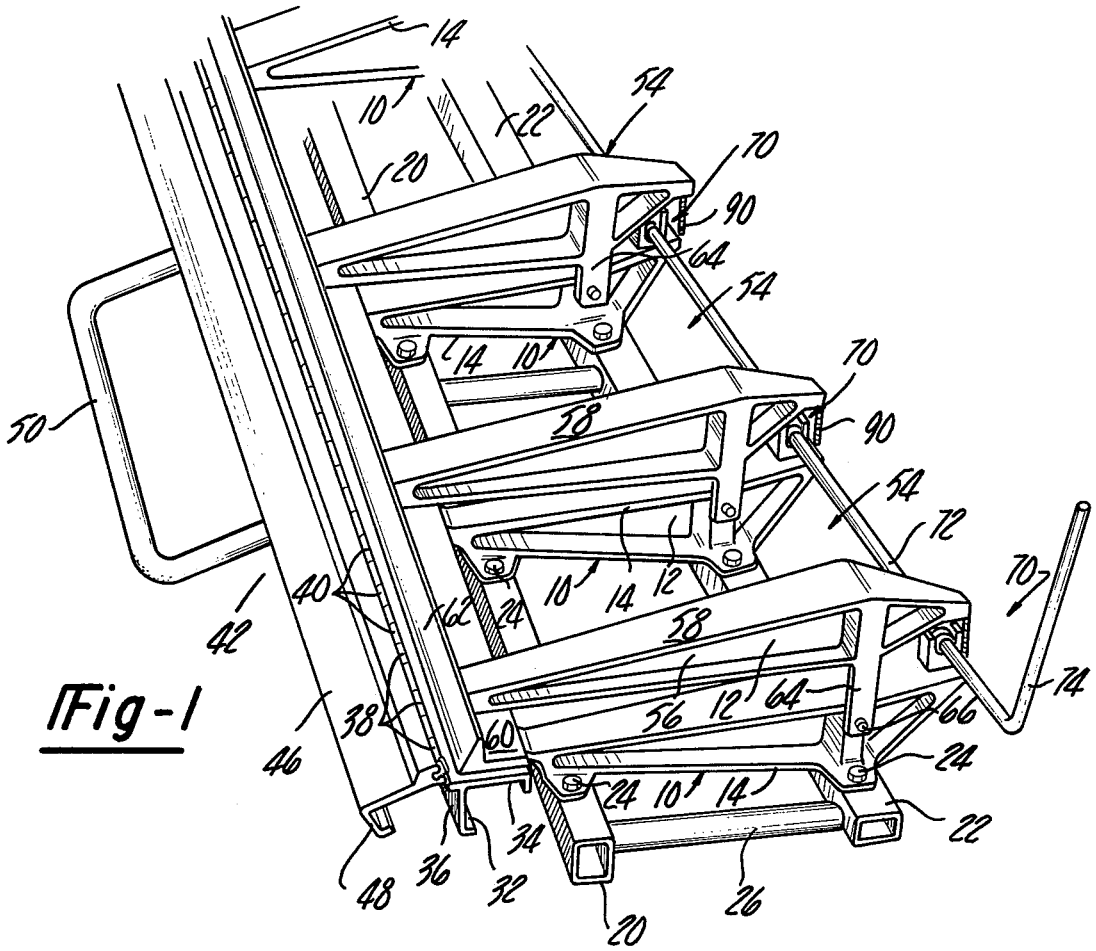
FIG. 1 is a top perspective view of a press formed in accordance with a preferred embodiment of the invention, with the end broken away to illustrate the fact that the press may be of any desired length.

Referring to the drawings, the embodiment of the invention illustrated in FIGS. 1–5 employs a plurality of cast aluminum or steel frame members, generally indicated at 10, which are identical to one another. Each member has a vertically aligned web 12 framed with horizontally extending edge webs 14. A forward horizontal mounting pad 16 projects horizontally from the lower edge of each frame member and a rear mounting pad 18 projects horizontally from the back of each frame. The front pads 16 of each of the frame members are secured to a square tubular aluminum channel 20 and the rear mounting pads 18 are similarly secured to a rectangular tubular aluminum frame member 22. The tubular members 20 and 22 extend parallel to one another and normally to the lower frame members 12. The frame members are spaced at regular intervals along the tubular members. The number of frame members employed depends upon the length of the press, and presses may be formed at any convenient length. The perspective view of the press in FIG. 1 is broken away at the top end to show the independence of the invention from any particular number of frame members or press length.

A tubular hand 26 extends between the front and rear frames 20 and 22 adjacent to at least one end of the brake and allows the brake to be conveniently carried.

Each of the frame members 10 has a forward and upward extending section 28 which has a flat flange 30 on its top and forward edges. A long aluminum extrusion 32 which forms a fixed clamp or anvil is secured over the top and forward edges of the flanges 30. The longitudinal axis of the clamp section 32 thus extends normally to the extension of the lower frame members 10.

The length of the clamping member 32 is determined by the number of frame members 10 provided in the press, and their spacing relative to one another. The ends of the clamping members preferably extend shortly beyond the two end framing members. The frame members 32 each have a right angle cross-section including a horizontally extending section 34 which forms the clamping surface and a vertically downward extending section 36 which rigidifies the clamping section.

A series of longitudinally extending hinge members 38 having a central hole extruded therein are formed as a forward extension of the clamping section 34, beyond the vertical front face 36. The sections 38 are spaced regularly along the lengths of the clamping section 32. They cooperate with complementary formed hinge sections 40 formed at one end of an elongated bending rail generally indicated at 42. End sections 40 on the bending rail are likewise spaced relative to one another and interleave with the fixed hinge sections 36. A hinge pin 44 projects through the hinge members 38 and 40, to form a piano hinge which pivotably supports the bending member 42 for pivotal motion about the hinge axis.

The bending arm 42 has a right angled cross-section, consisting of a section 46 and a right angle strengthening web 48. Bending section 51 is formed on the edge of the section 46 adjacent the hinge 44 and is adapted to engage a workpiece in a manner which will subsequently be described. A removable handle member formed of a U-shaped tube 50 is secured to the midpoint of the section 48 by set screws 52 so as to be easily removable.

The press includes a plurality of pivotable bending arms generally indicated at 54, preferably equal in number to the frame members 10, with one arm 54 being supported in parallel relationship with each frame member 10. The arms 54 are shaped much like the frames 10, with an elongated central web 56 and upper and lower flanges 58. At their forward ends, the arms 54 all support a normally extending extrusion which forms a movable clamping member 60. Clamping member 60 has a downwardly facing working surface which extends parallel to and in direct opposition to the fixed clamping surface 34 of the member 32. The forward edge of the movable clamping surface is in substantial alignment with the hinge members 38 and 40 and is spaced slightly to the rear of the hinge line. The movable clamping member 60 has an upwardly inclined forward anvil face 62 that meets its lower clamping surface at an angle of approximately 40° to 60°.

The arms 54 each have a pair of downwardly extending pivot sections 64 which project normally to the elongate axis of the arms, a short distance from their rear ends. These sections 64 are joined by pins 66 to their complementary frame members 10 and the pins pass through appropriate holes formed in the frame members. These joints allow the frame members 54 to pivot with respect to the frame members 10 so that the clamping section 60 may be moved toward and away from the fixed clamping section 34.

In the embodiment of FIGS. 1–5 this pivoting motion is controlled by a cam mechanism, generally indicated at 70, one of which is associated with each set of arm and frame members. The cam mechanism is detailed in FIGS. 4 and 5. It includes a single elongated rod 72 which has bent ends 74 which serve as handles. Rod 72 extends normally to the longitudinal axes of the frames and the arms and passes between their rear ends, on the opposite side of the pivot point from the clamping sections 34 and 60. Cam members 76 are secured to the rod 72 between each arm and frame pair by set screws 78. The cams each include an eccentric section 80 and a concentric flange section 82. One edge of the eccentric section 80 bears against the upper surface of the associated frame member 10. The concentric section 82 of each cam is retained within an open end U-shaped frame member 84 supported on the upper surface of each frame member. An adjustable bearing screw 86 which projects downwardly from the bottom of each arm member 54 bears against the outer surface of the concentric section 82.

The rear ends of each frame member 10 and arm 54 are normally biased toward each other by springs 90 secured to the members by upper and lower screws 92 and 94 respectively which project from their rear ends.

The rotational position of the rod 72 determines the spacing between the rear end of the arms. When the cam mechanism is in the position illustrated in FIG. 4, the concentric section 82 rests on the bottoms of the U-shaped members 84 and the rear ends of the respective arms 54 and frame members 10 are relatively close to one another. In this position the movable clamping member 60 is relatively widely spaced from the fixed clamping member 30 allowing insertion and removal of workpieces 96 between the two. As the rod 72 is rotated through the handle 74, the eccentric section 80 of the cams bear against the upper surfaces of the frame members 10 and lift the concentric sections 82 within the U-frames 84, to a position illustrated in FIG. 2 wherein the rear ends of the arms and frames are separated from one another.

During this motion the movable clamping surface 60 pivots downwardly against the fixed clamping surface 30, trapping any workpiece section 96 which is supported between them. A relatively small motion of the rear ends of the arms produces a relatively large motion of the movable clamping surface with respect to the fixed clamping surface because of the lever advantage provided by the differences in distances between the pivot axis and the two opposite ends of the arms. The screw members 86 may be adjusted to compensate for wear in the mechanism.

Figure 2:
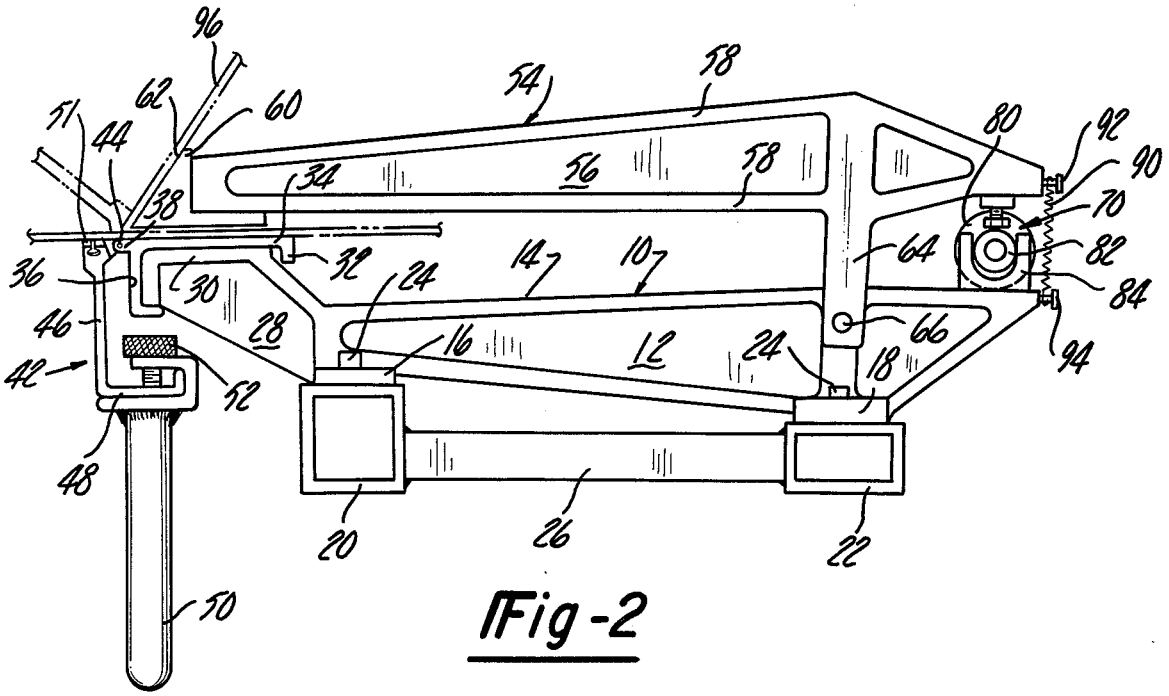
FIG. 2 is an end view of the press of FIG. 1.
Figure 3:
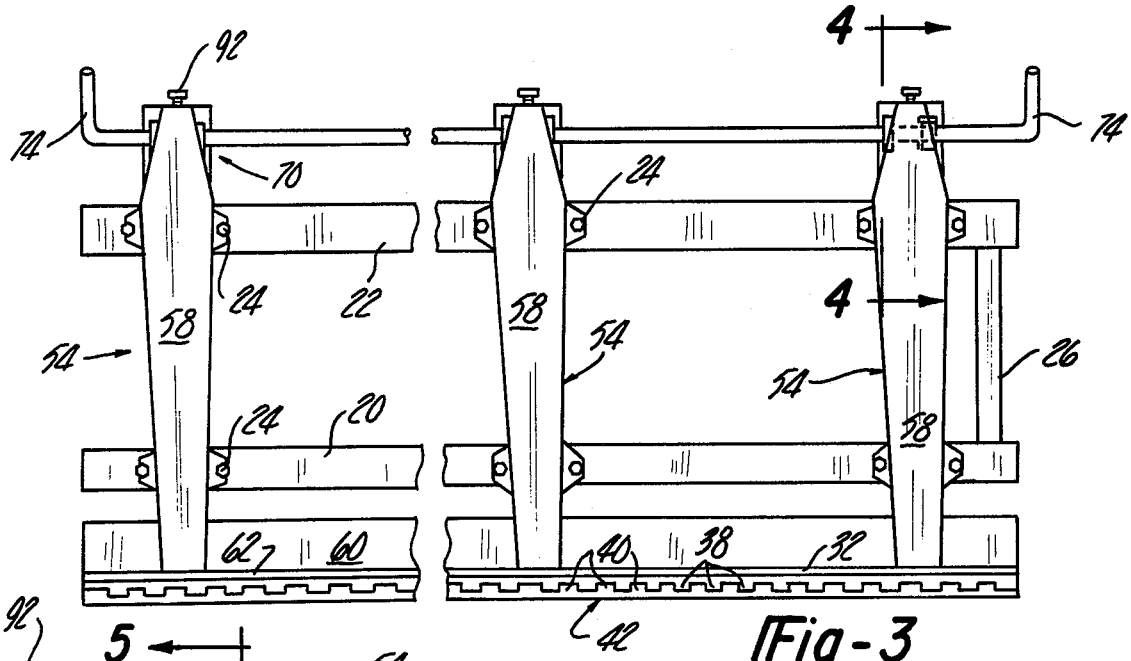
FIG. 3 is a top view of the press of FIG. 1, broken away along its length.
Figure 4:
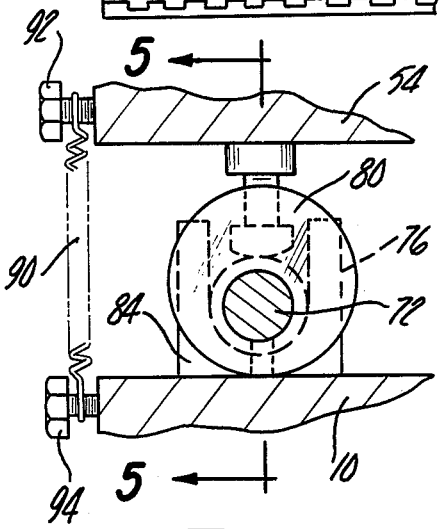
FIG. 4 is a detailed elevational sectional view of the cam actuation mechanism for one of the arms, taken along line 4—4 of FIG. 3.

The press is used in a conventional manner. While the clamping surfaces 34 and 60 are relatively separated, the sheet metal workpiece 96 is inserted between them so that the edge to be bent is aligned with the lower forward corner of the movable bending member 60. During this insertion the bending section 46 is in a downward position, as illustrated in FIG. 2. The handles 74 are then rotated to move the clamping surface 60 into engagement with the clamping surface 34, locking the workpiece 96 between the two. The bending member is then pivoted upwardly, using the handle 50, to bring the surface 51 into engagement with the extending section of the workpiece, forcing the workpiece upwardly and bending it about the nose at the bottom of the angular section 62. The handles 74 are then rotated to release the workpiece.

Figure 5:
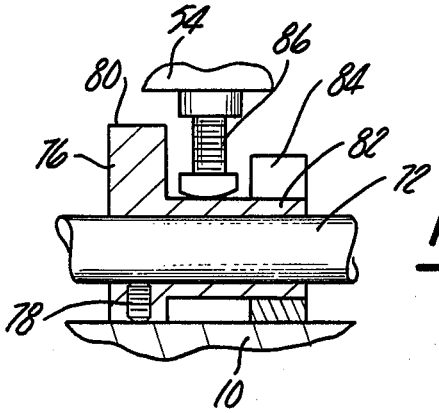
FIG. 5 is a sectional view through the detail of FIG. 4 taken along line 5—5 of FIG. 4.
Figure 6:
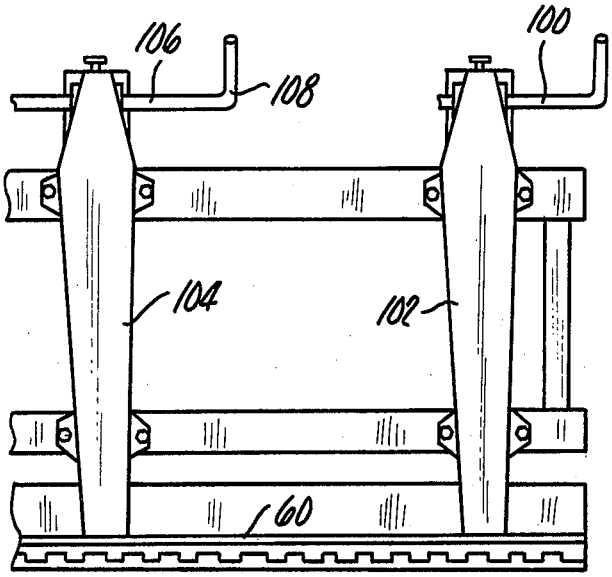
FIG. 6 is a top view of an alternative embodiment of the invention wherein independent actuator means are provided for one arm at the end of the press.

FIG. 6 illustrates an alternative embodiment of the invention which differs from the embodiment of FIG. 5 in that a separate cam actuating handle 100 is provided for one of the arm members 102. All of the other arm members 104, only one of which is shown, are actuated by a separate, common rod 106, and handle member 108. The movable clamp section 60 is supported on the arm member 102 as well as the arm members 104. This arrangement allows one edge of the movable clamp 60 to be brought into engagement with the fixed clamp. Using this arrangement, a workpiece may be inserted between the opened clamps and then pinned at one point by actuating the handle to pivot the single arm 102 about the frame. This pins the workpiece at a single point and the workpiece may then be pivoted about that point to accurately align it with respect to the bending edge. The movable clamp 60 is sufficiently resilient to allow this type of operation.

I claim:

1. A sheet metal brake comprising: a base having an elongated, substantially horizontal, fixed, work clamping surface; a plurality of elongated arms each extending normally to the length of said fixed work clamping surface; pivot sections fixed to each of the arms near a first end of each arm, extending normally to the arms and being pivotably connected to the base for motion about an axis extending parallel to said fixed work clamping surface and normally to the lengths of said arms; an elongated movable work clamping member fixed to the second end of each of said arms and extending normally to said arms and parallel to said work clamping surface, said clamping member having a flat surface adapted to cooperate with said fixed clamping surface to retain a sheet workpiece therebetween, and a flat anvil surface extending at an acute angle with respect to said workpiece clamp surface so as to form an elongated bending nose with said workpiece clamping surface; actuator means supported between the base and the first ends of at least certain of the arms, the actuator means being adapted to move the arms about their pivotal connections with the base between a closed position wherein the movable work clamp is in close spaced relationship to the fixed clamping surface so as to clamp a sheet workpiece therebetween, and an open position wherein the movable clamp is spaced from the fixed work clamping surface to allow insertion or removal of workpieces therebetween; and an elongated bending arm pivotably supported with respect to the base on an axis extending parallel to the fixed and movable work clamps.

2. The brake of claim 1 wherein said actuator means comprises cam means rotatably supported about an axis parallel to said fixed and movable work clamps and means for rotating the cam means to force pivoting motion of the arms with respect to the base.

3. The brake of claim 2 wherein said cam means comprises a plurality of rotatable cams, each adapted to engage the base member at a point between one of the arms and the base member, an elongated shaft fixed to each of the cams so that rotation of the shaft forces movement of the shaft toward and away from the base, and bearing means fixed between each of the arms and the shaft so that motion of the shaft toward and away from the base upon rotation of the shaft causes pivoting motion of the arms relative to the base.

4. The brake of claim 3 including a handle member affixed to the shaft at an angle with respect thereto so that the handle member may be moved to cause rotation of the shaft.

5. The brake of claim 1 where the points of pivotable connection of each of the arms to the base member are substantially closer to the ends of the arms cooperative with the actuator means than they are to the ends of the arms which support the movable work clamp, whereby a relatively small motion of the actuator means produces a relatively large motion of the movable work clamp relative to the fixed work clamp.

6. The sheet metal brake according to claim 1 wherein said actuator means includes means for actuating one of said arms about their pivot points independently of the other arms whereby said sheet workpiece may be initially clamped by said arms to allow positioning with respect to the other of said arms.

* * * * *